US006649890B1

(12) United States Patent
Brinker et al.

(10) Patent No.: US 6,649,890 B1
(45) Date of Patent: Nov. 18, 2003

(54) MICROWAVE COOKING APPLIANCE INCORPORATING ELECTRIC HEATING ELEMENT

(75) Inventors: David W. Brinker, Cleveland, TN (US); Robert Z. Whipple, Jr., Louden, TN (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/299,821

(22) Filed: Nov. 20, 2002

(51) Int. Cl.[7] ..... H05B 6/72; H05B 6/80

(52) U.S. Cl. ..... 219/685; 219/681; 219/746; 219/748

(58) Field of Search ..... 219/685, 681, 219/745, 746, 748, 756, 751, 750

(56) References Cited

U.S. PATENT DOCUMENTS

| | | | | |
|---|---|---|---|---|
| 2,920,174 A | * | 1/1960 | Haagensen | 219/685 |
| 3,339,054 A | * | 8/1967 | Deaton | 219/685 |
| 3,549,849 A | * | 12/1970 | Boehm | 219/748 |
| 4,028,520 A | | 6/1977 | Torrey | |
| 4,028,521 A | | 6/1977 | Uyeda et al. | |
| 4,326,113 A | | 4/1982 | Toyoda et al. | |
| 4,358,653 A | | 11/1982 | Weiss | |
| 4,410,779 A | | 10/1983 | Weiss | |
| 4,412,117 A | | 10/1983 | Dudley et al. | |
| 4,549,054 A | | 10/1985 | Aoyama | |
| 4,908,488 A | | 3/1990 | Park | |

FOREIGN PATENT DOCUMENTS

| | | | | |
|---|---|---|---|---|
| EP | 0 632 678 | * | 1/1995 | 219/746 |
| GB | 2202623 | | 9/1988 | |

* cited by examiner

*Primary Examiner*—Philip H. Leung
(74) *Attorney, Agent, or Firm*—Diederiks & Whitelaw, PLC

(57) ABSTRACT

A microwave cooking appliance includes a sheathed resistive electric heating element including an outer portion, an inner portion and a cross-over portion electrically interconnecting the outer and inner portions. The heating element is arranged in a cooking chamber of the microwave cooking appliance in a manner which effects an impedance characteristic of the cooking chamber. The cross-over portion is arranged such that the heating element acts like an RF antenna moving a microwave energy field to portions of the cooking chamber in which low electric fields occur. In this manner, the broil element helps increase the operational efficiency of the cooking applaince by minimizing any hot and cold spots within the cooking chamber.

17 Claims, 6 Drawing Sheets

MICROWAVE COOKING APPLIANCE INCORPORATING ELECTRIC HEATING ELEMENT

BACKGROUND OF THE INVENTION

1. Field of the Invention

The present invention pertains to the art of microwave cooking appliances and, more particularly, to a microwave cooking appliance including a heating element mounted within a cooking chamber such that impedance characteristics of the heating element substantially match impedance characteristic of the cooking chamber in order to reduce the occurrence of high and low electric fields.

2. Discussion of the Prior Art

The art of cooking is currently undergoing substantial change. It is no longer the norm to have a family member home all day with time to cook and prepare meals. Today, more and more consumers must rush home from work to prepare meals for themselves or for their families. In today's fast paced society, time is of the essence. The luxury of spending time in preparing a meal is becoming less and less affordable. As such, consumers demand an oven that will cook a meal in less time than conventional ovens, without sacrificing the quality of the prepared food. In order to meet these demands, manufacturers are combining conventional cooking systems with the rapid cook advantages of microwave cooking systems.

Cooking appliances utilizing a directed microwave energy field to cook a food item have existed for some time. In such a cooking appliance, food is heated by directing standing microwaves into a cooking chamber where the microwave energy is directed upon the food item to be cooked. As the microwaves are reflected within the chamber, they impinge upon the food item, causing the food item to undergo a cooking process. The nature of the standing waves often results in localized areas of high and low energy fields which, coupled with other factors, cause the food to cook unevenly. This is especially true in larger ovens where the size of the cooking chamber requires a more uniform energy distribution in order to properly cook the food. In addition to confronting the design challenges related to incorporating microwave cooking into larger ovens, combining conventional cooking elements with the microwave systems requires specific considerations relating to the internal geometry of the cooking chamber.

For example, introducing conventional electrical heating elements into a microwave oven chamber will impact the impedance characteristics of the chamber. Not only do the microwaves reflect from the chamber walls, but the microwaves would also reflect from the heating elements themselves. Accordingly, the number of modes, and thus hot and cold spots resulting from high and low energy fields, would increase dramatically.

Several methods have been proposed in the prior art to address problems with these methods ranging from providing shields for the heating elements in the form of panels, or locating the heating elements below a food support or the like. Each of these arrangements adds to the cost, and can actually detract from the overall efficiency of the system. Other manufacturers choose to ignore the problem entirely in simply incorporating heating elements within the cooking chamber. In any event, despite the prior art arrangements, there exists a need for a microwave cooking appliance employing an electric heating element designed to be incorporated into a cooking chamber wherein the impedance characteristics of the element substantially matches the impedance characteristics of the cooking chamber, thus reducing the effects of moding during a cooking process.

SUMMARY OF THE INVENTION

The present invention is directed to a microwave cooking appliance including an electrical heating element mounted within a cooking chamber. Specifically, the electrical heating element is preferably constituted by sheathed, resistive electrical element defining a broil element having impedance characteristics which, when properly arranged, substantially match the impedance characteristics of the cooking chamber. More specifically, the microwave cooking appliance includes a cooking chamber having interior and exterior upper surfaces, a toroidal-shaped waveguide including a bottom surface having an interior diameter and an exterior diameter, a waveguide input extending from the waveguide, a magnetron arranged on the waveguide input, and a sheathed electric heating element arranged on the interior upper surface of the cooking chamber, wherein the waveguide and electrical heating element includes complementary configurations designed to enhance the overall cooking performance of the appliance.

In a preferred embodiment, the sheathed resistive electric heating element includes an outer portion extending about and preferably suspended from the interior upper surface of the cooking cavity, an inner portion extending about an inner diameter of the bottom surface of the waveguide, and a cross-over portion electrically interconnecting the outer and inner portions. In accordance with the invention, the heating element is sized such that the element provide a sufficient amount of heat output necessary to perform a variety of cooking operations. In addition, the element is shaped and located so as to tune the impedance characteristics of the element. In this manner the heating element acts in a manner similar to an RF antenna, directing RF energy within the cooking chamber to areas of low electric field concentrations.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE INVENTION

Figure 1:
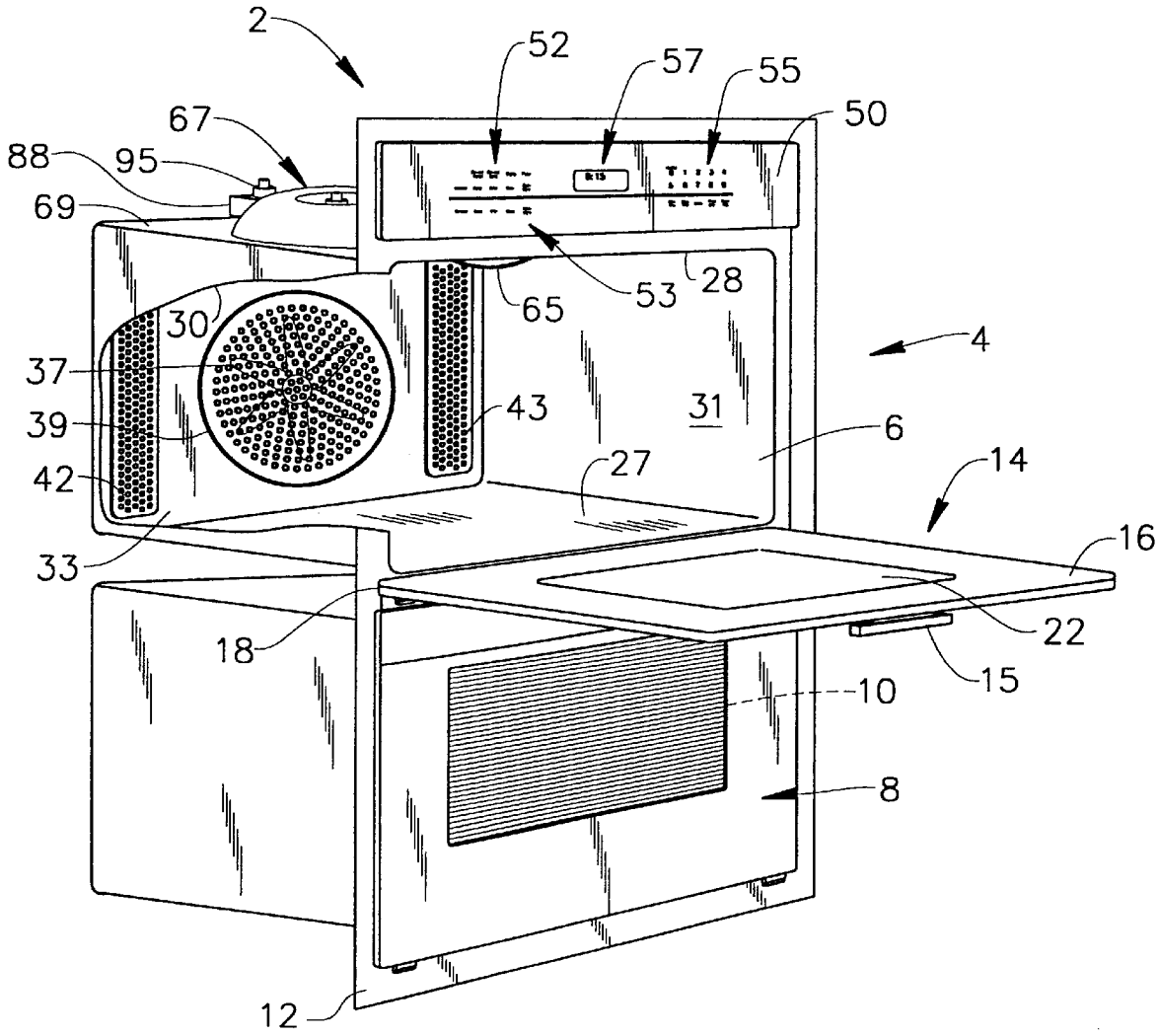
FIG. 1 is a perspective view of a combination microwave/convection wall oven including an electrical broil element and toroidal waveguide constructed in accordance with a preferred embodiment of the present invention.

With initial reference to FIG. 1, a microwave cooking appliance constructed in accordance with the present invention is generally indicated at 2. Although the form of cooking appliance 2 in accordance with the present invention can vary, the invention is shown in connection with cooking appliance 2 depicted as a wall oven. More specifically, in the embodiment shown, cooking appliance 2 constitutes a dual oven wall unit including an upper oven 4 having upper cooking chamber 6 and a lower oven 8 having a lower cooking chamber 10. In the embodiment shown, upper oven 4 is adapted to perform a rapid cook or combination microwave/convection cooking process, and lower oven 8 is provided to perform a standard convection and/or radiant heat cooking operation. As shown, cooking appliance 2 includes an outer frame 12 for supporting upper and lower cooking chambers 6 and 10.

In a manner known in the art, a door assembly 14 is provided to selectively provide access to upper cooking chamber 6. As shown, door assembly 14 is provided with a handle 15 at an upper portion 16 thereof. Door assembly 14 is adapted to pivot at a lower portion 18 to enable selective access to within cooking chamber 6. In a manner also known in the art, door 14 is provided with a transparent zone 22 for viewing cooking chamber 6 while door 14 is closed.

As best seen in FIG. 1, cooking chamber 6 is defined by a bottom portion 27, an upper portion 28, opposing side portions 30 and 31, and a rear portion 33. Bottom portion 27 is preferably constituted by a flat, smooth surface designed to improve the cleanability, serviceability, and reflective qualities of cooking chamber 6. In the embodiment shown, arranged on rear portion 33 is a convection fan 37 having a perforated cover 39 through which heated air can be withdrawn from cooking chamber 6. Heated air is re-introduced into cooking chamber 6 through vents 42 and 43 arranged on either side of fan 37. Although cooking appliance 2 is depicted as a wall oven, it should be understood that the present invention is not limited to this model type and can be incorporated into various types of oven configurations, e.g., cabinet mounted ovens, as well as slide-in and free standing ranges.

Further shown in FIG. 1, cooking appliance 2 includes an upper control panel 50 incorporating first and second rows of oven control button rows 52 and 53. Control buttons 52 and 53, in combination with a numeric pad 55 and a display 57, enable a user to establish particular cooking operations for upper and lower ovens 4 and 8 respectively. Since the general programming and operation of cooking appliance 2 is known in the art and does not form part of the present invention, these features will not be discussed further here. Instead, the present invention is particularly directed to the incorporation and construction of a broil element 65 which preferably takes the form of a sheathed electric resistive heating element arranged on upper portion 28 as will be set forth more fully below.

Figure 2:
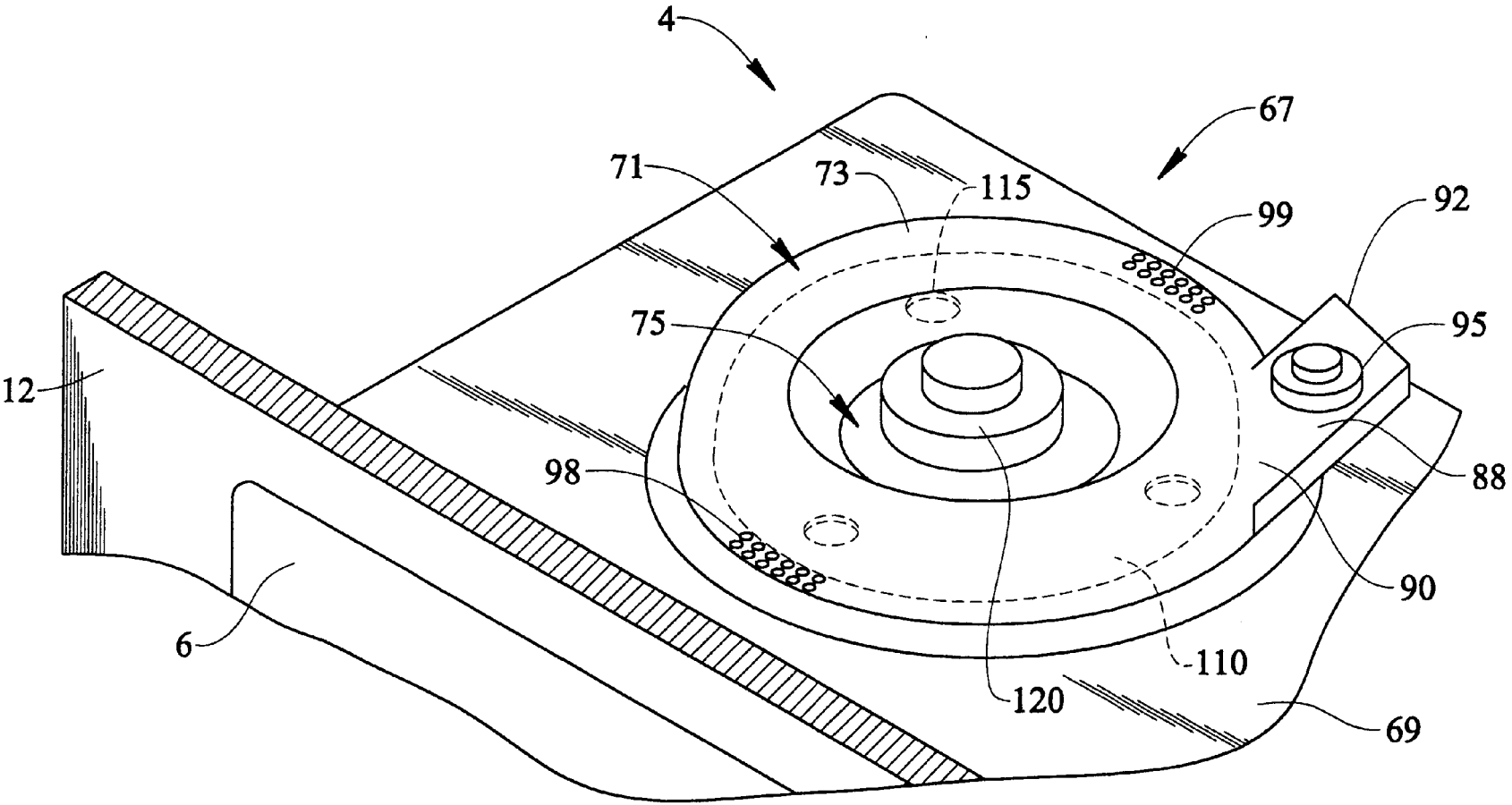
FIG. 2 is a partial perspective view of the toroidal waveguide mounted in accordance with the present invention.
Figure 3:
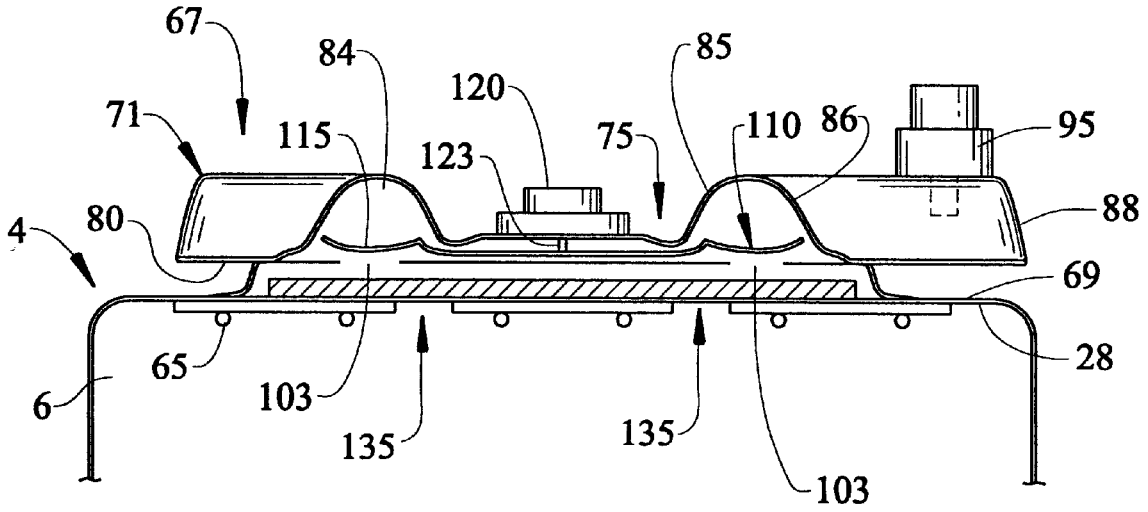
FIG. 3 is a cross-sectional view of a portion of the toroidal waveguide of FIG. 2, including a broil element arranged in accordance with the present invention.
Figure 4:
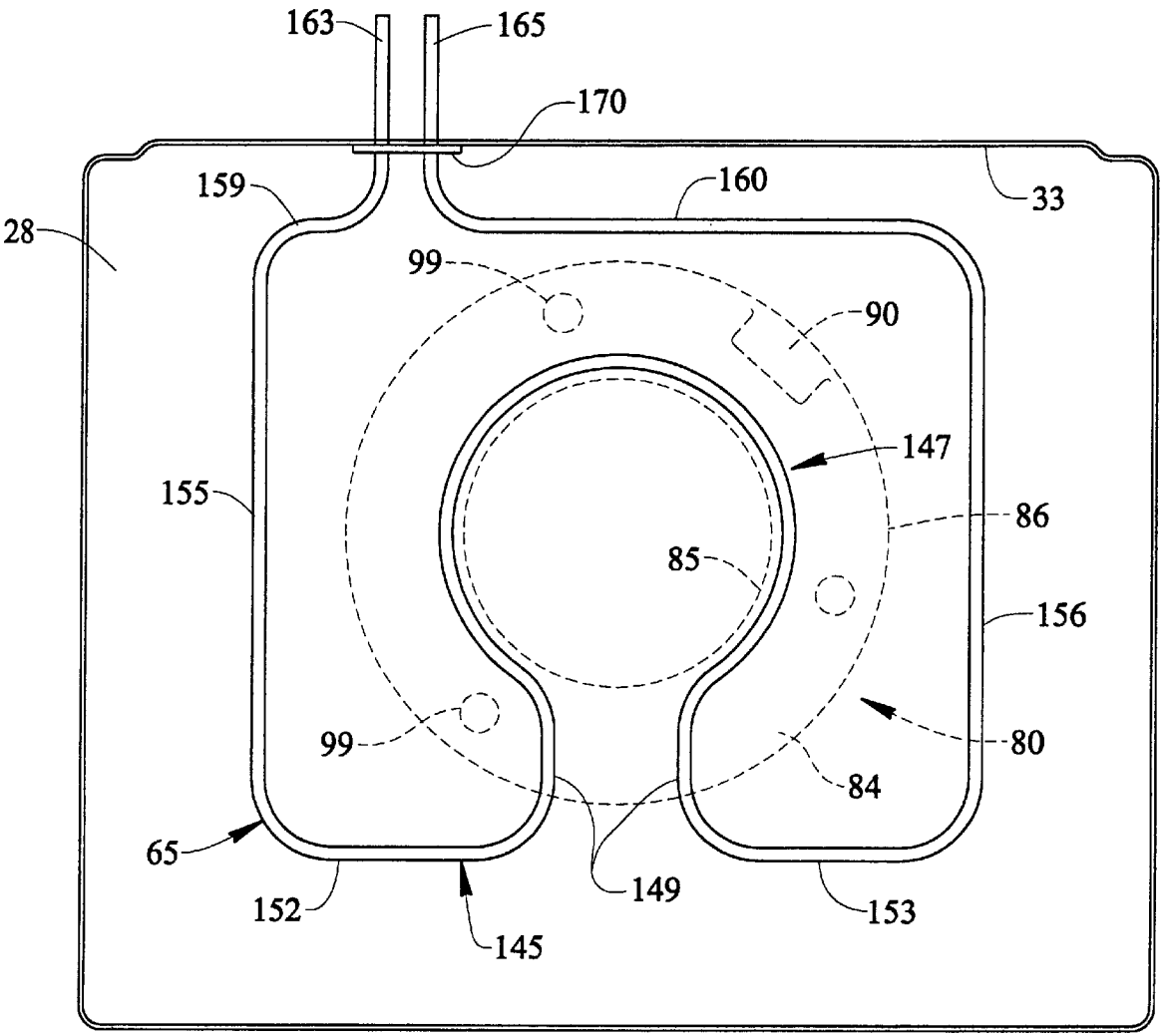
FIG. 4 is a plan view of an upper oven cavity employed in the wall oven of FIG. 1, particularly illustrating the broil element of FIG. 3 arranged in accordance with one form of the present invention.

With reference to FIGS. 2 and 3, a waveguide 67 is shown mounted on an exterior upper portion 69 of cooking chamber 6. More specifically, waveguide 67 includes an annular toroidal ring cover 71 having an upper surface 73 defining a central depression 75, and a bottom surface 80. In a preferred form of the invention, waveguide 67 further includes a hollow interior portion 84 having a defined torus ring or cross-sectional diameter and a defined centerline diameter. As shown in FIGS. 3 and 4, hollow interior portion 84 is generally defined by an inner wall portion 85 and an outer wall portion 86. Waveguide 67 is preferably formed from coated aluminum which provides enhanced reflective qualities while also decreasing any IR emissivity. As such, energy loses due to the absorption of microwave energy are minimized. In a preferred arrangement, the torus ring diameter of waveguide 67 is set equal to $\frac{1}{2}\lambda$, and the centerline diameter of waveguide 67 is equal to $2\lambda$, where $\lambda$ is defined as the wavelength of the microwave energy field transmitted into waveguide 67.

As best shown in FIG. 2, a launching zone 88 is provided which includes a first end defining an exit 90 opening into waveguide 67, and a second, terminal end 92. Mounted on an upper portion of terminal end 92 is a magnetron or microwave emitter 95. In a manner known in the art, magnetron 95 emits microwaves of a defined wavelength ($\lambda$) into launching zone 88. In a preferred configuration, magnetron 95 emits microwave energy at a wavelength of 2.45 GHz. However, it should be noted that waveguide 67 of the present invention is adaptable to any acceptable wavelength used for cooking.

Referring further to FIG. 2, arranged about a front portion of waveguide 67 are a plurality of inlet openings 98. More specifically, inlet openings 98 are positioned to allow a flow of cooling air to enter interior portion 84. Additionally, a plurality of exhaust openings 99 are arranged on a rear portion of waveguide 67, adjacent to launching zone 88, to allow heated air to escape from interior portion 84. In this manner, waveguide 67 also serves as an air duct, further eliminating the amount of insulation required over cooking chamber 6. Inlet openings 98 and exhaust openings 99 are sized and positioned such that the reflected microwave energy field will not escape from interior portion 84.

As best seen in FIG. 3, a plurality of cavity excitation ports 103 are arranged about bottom surface 80 of waveguide 67. Specifically, cavity excitations ports 103 are located about bottom surface 80 at each point where a maximum energy node will occur. As such, in the most preferred form of the invention, three equally spaced excitation ports are positioned at $\frac{1}{2}\lambda$ points located about bottom surface 80.

Referring back to FIGS. 2 and 3, a stirring plate 110 is shown rotatably mounted within interior portion 84. In a preferred form of the invention, a plurality of openings 115 are arranged about stirring plate 110. In the most preferred form of the invention, the number of openings 115 correspond to the number of cavity excitation ports 103. Stirring plate 110 is driven by a motor 120 arranged within central depression 75, with motor 120 being drivingly connected to stirring plate 110 through shaft 123. Shaft 123 is formed from a dielectric material such that it does not interfere with the microwave energy field. Alternatively, in place of using a dielectric material, shaft 123 can be grounded to cooking appliance 2 to avoid interference with the microwave energy field.

The actual use of cooking appliance 2 in connection with microwave cooking is described in co-assigned U.S. patent applications Ser. No. 10/299,918 entitled "TOROIDAL WAVEGUIDE FOR A MICROWAVE COOKING APPLIANCE" filed on Dec. 20, 2002 and incorporated herein by reference. As indicated above, the present invention is particularly directed to the incorporation of broil element 65 and, more specifically, to the particular configuration of broil element 65 within cooking chamber 6. In one form of the invention as shown in FIG. 4, broil element 65 includes an outer portion 145, an inner portion 147, and a cross-over portion 149 which electrically interconnects outer portion 145 and inner portion 147. As shown, outer portion 145 includes front sections 152 and 153, opposing side sections 155 and 156, and rear sections 159 and 160. In a preferred arrangement, rear sections 159 and 160 terminate in respective terminal ends 163 and 165 that extend through rear portion 33 of cooking chamber 6. In a manner known in the art, terminal ends 163 and 164 are electrically connected with oven control components (not shown). In addition, an insulating plate 170 is arranged at the interface of rear portion 33 and broil element 65 to isolate broil element 65 from other portions of upper oven 4.

In the embodiment shown, broil element 65 extends directly along and adjacent upper portion 28. In a preferred form of the invention, outer portion 145 has an associated heat output necessary to perform a pre-heat function, a broil function, and other supplemental oven cavity heating functions. Furthermore, inner portion 147 is dimensioned such that the diameter of inner portion 147 is slightly greater than the diameter of inner wall portion 85 of hollow interior portion 84 of waveguide 67, while outer portion 145 is larger than a diameter of outer wall portion 86.

While the dimensions of broil element 65 are considered important to the overall arrangement of the present invention, more important is the location of cross-over section 149 relative to microwave launching zone 88. Incorporating additional structure into a microwave cooking chamber inherently involves several drawbacks, not the least of which is the change in the impedance characteristics of the cooking chamber. In accordance with the invention, broil element 65 is effectively positioned and, more particularly, cross-over portion 149 is arranged so that it acts in a manner similar to an RF antenna, i.e., cross-over portion 149 will direct RF energy to portions of cooking chamber 6 that have lower concentrations of microwave energy. Accordingly, arranging cross-over portion 149 such that it lies substantially along an imaginary line extending through microwave launching zone 88 advantageously functions to tune the impedance characteristics of broil element 65 with the impedance characteristics of cooking chamber 6. In this manner, broil element 65 helps direct the RF energy within cooking chamber 6. Accordingly, cross-over portion 149 is preferably arranged centrally along front edge portions 152 and 153.

Figure 5:
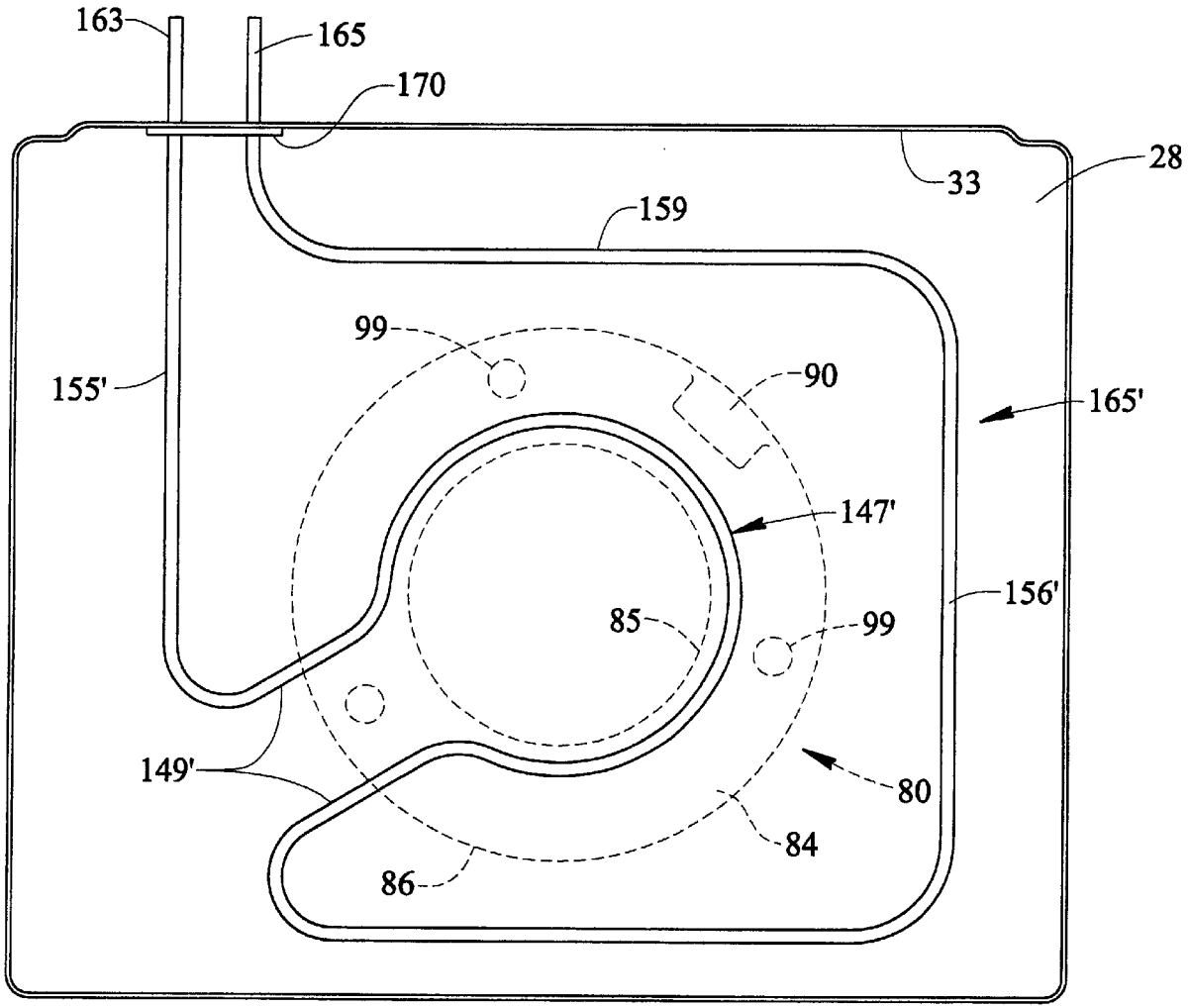
FIG. 5 is a plan view, similar to that of FIG. 4, but illustrating a broil element constructed in accordance with a second preferred embodiment of with the present invention.

In another embodiment of the invention as shown in FIG. 5, a broil element 65' is arranged in accordance with another form of the present invention. In a manner similar to that set forth above, broil element 65' includes outer portion 145', inner portion 147', and a cross over portion 149' electrically interconnecting outer portion 145' and inner portion 147'. In order to more closely tune the impedance characteristics of broil element 65' with cooking chamber 6, cross-over portion 149' is positioned in a manner to closely align with microwave launching zone 88. Accordingly, as shown in FIG. 5, cross-over portion 149' is located at the junction of front portion 152' and side portion 155'. In this manner, cross-over portion 149' tunes broil element 65' to more closely match the impedance characteristics of cooking chamber 6.

Figure 6:
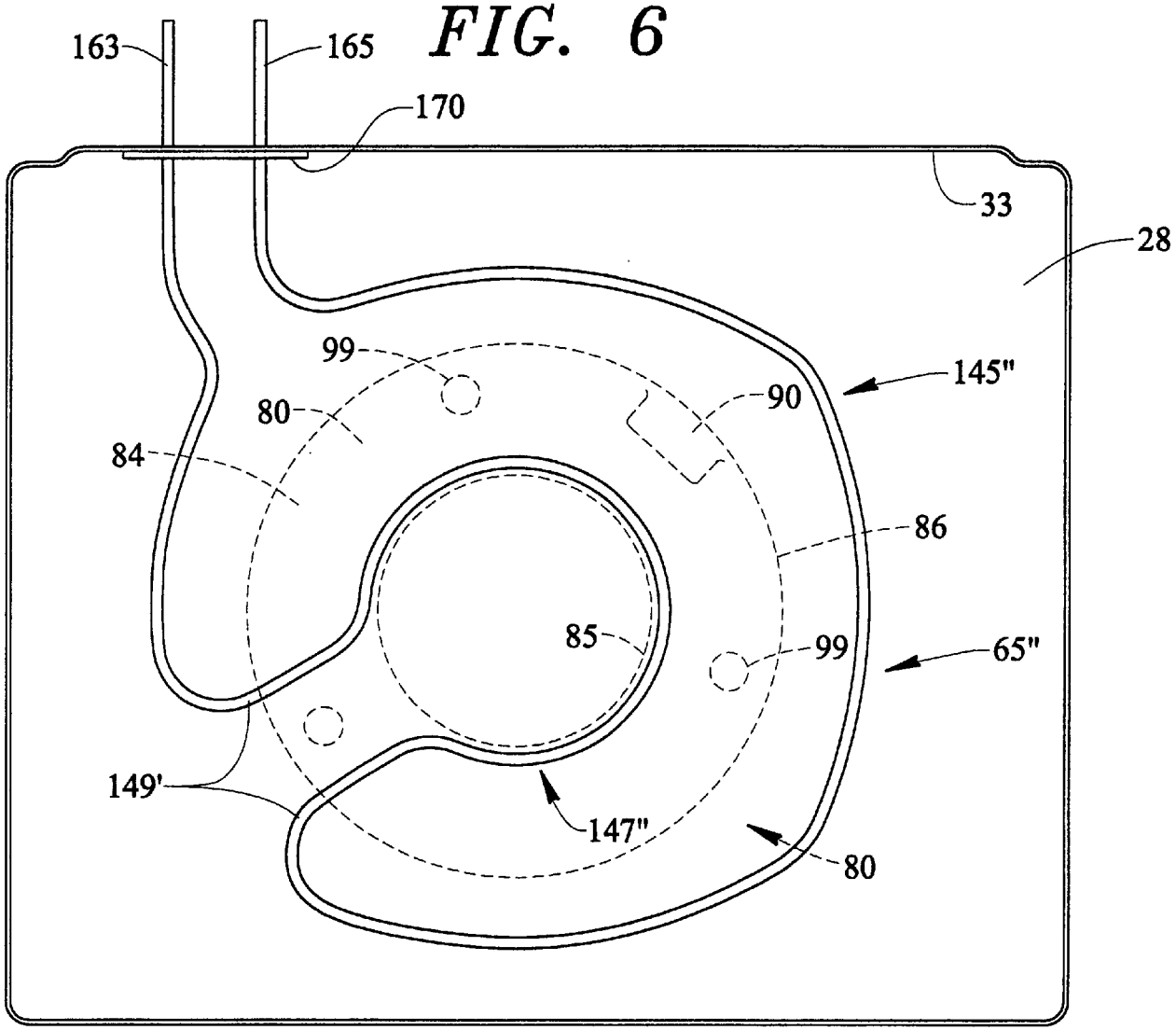
FIG. 6 is a plan view, similar to that of FIG. 4, but illustrating a broil element constructed in accordance with a third preferred embodiment of with the present invention.

In accordance with a still further embodiment of the present invention as shown in FIG. 6, a broil element 65" is shown to have an outer portion 145" formed generally in the shape of a circle. As shown, outer portion 145" extends about and encompasses inner portion 147". In a manner similar to that described above, outer portion 145" is interconnected to inner portion 147" through cross-over portion 149". In this preferred form of the invention, cross-over portion 149" is substantially aligned with microwave launching zone 88. It has been found that circular outer portion 145" and inner portion 147", in combination with the location of cross-over portion 149", presents a close impedance match to cooking chamber 6.

Although described with reference to preferred embodiments of the invention, it should be readily understood that various changes and/or modifications can be made to the invention without departing from the spirit thereof. For instance, the launching zone or microwave input section may be located at any point around the toroidal ring cover as long as corresponding changes to the location of the cross-over portion are made. Additionally, the toroidal waveguide can be arranged in other areas with respect to the cooking chamber, including a corresponding change in the location of the broil element. For instance, the waveguide can be mounted on the bottom or rear portions of the cooking chamber. Furthermore, the present invention can be used in combination with a self-clean operation. Certainly, the cooking appliance into which the present invention is incorporated may vary in type, size and model. Particularly, based on these various embodiments, it should be readily apparent that various configurations for the broil element of the invention are available. In general, the invention is only intended to be limited by the scope of the following claims.

We claim:

1. A microwave cooking appliance comprising:
   - a cooking chamber including an interior surface and an opposing, exterior surface;
   - a toroidal-shaped waveguide, defining an inner diameter and an outer diameter, mounted on the exterior surface of the cooking chamber and including at least one opening leading into the cooking chamber;
   - a microwave generator for emitting a microwave energy field of a defined wavelength into the waveguide; and
   - an electric heating element including an outer portion extending along the interior surface of the cooking chamber, an inner portion extending about the inner diameter of the waveguide, and a cross-over portion electrically interconnecting the outer and inner portions, wherein the heating element is adapted to radiate heat into the cooking chamber during at least select portions of a cooking operation.

2. The microwave cooking appliance according to claim 1, further comprising: a launching zone having a first end portion connected to the waveguide and a second end portion upon which the microwave generator is mounted.

3. The microwave cooking appliance according to claim 2, wherein the cross-over portion is arranged substantially across from the launching zone whereby the cross-over portion effects an impedance characteristic of the cooking chamber such that microwave energy is directed to areas of low electric fields.

4. The microwave cooking appliance according to claim 1, further comprising: a control for establishing a desired heating operation for the electric heating element.

5. The microwave cooking appliance according to claim 4, wherein the electric heating element constitutes a broil element.

6. The microwave cooking appliance according to claim 5, wherein the electric heating element constitutes a sheathed resistive electric heating element.

7. The microwave cooking appliance according to claim 1, wherein the outer portion of the electric heating element extends about the outer diameter of the waveguide.

8. The microwave cooking appliance according to claim 1, further comprising: a convection fan adapted to create an airflow within the cooking chamber for a convection cooking process.

9. The microwave cooking appliance according to claim 1, further comprising: an insulating plate arranged between the cooking chamber and the waveguide.

10. In a combination microwave, convection and radiant cooking appliance having a cooking chamber including an upper surface, an electric heating element comprising:

an outer portion, including a pair of terminal ends, supported by and extending about a first portion of the upper surface of the cooking chamber;

an inner portion arranged within the outer portion and extending about a second portion of the upper surface of the cooking chamber; and a cross-over portion electrically interconnecting the outer and inner portions, said cross-over portion being adapted to tune an impedance characteristic of the cooking chamber, wherein the cross-over portion is positioned to effect standing wave patterns of microwaves by directing the microwaves to areas of low electric energy thus reducing the occurrence of high and low electric fields within the cooking chamber and contributing to the overall efficiency of the cooking appliance.

11. The electric heating element according to claim 10, wherein the cross-over portion is arranged substantially across from a launching zone said microwave launching zone being adapted to direct a microwave energy field into the cooking chamber, whereby the cross-over portion acts as an RF antenna directing the microwave energy field to areas of low field concentration within the cooking chamber.

12. The electric heating element according to claim 10, wherein the heating element constitutes a broil element.

13. The electric heating element according to claims 12 wherein the heating element constitutes a sheathed, resistive electric heating element.

14. The electric heating element according to claim 13, wherein the outer portion of the sheathed resistive electric heating element extends about the outer diameter of the waveguide.

15. A method of tuning an impedance characteristic of a microwave cooking chamber having an interior upper surface comprising:

providing a microwave energy source to supply a microwave energy field to the cooking chamber;

providing a sheathed resistive electric heating element having an outer portion, an inner portion and a cross-over portion electrically interconnecting the outer and inner portions;

supporting the sheathed resistive electric heating element on the interior upper surface of the cooking chamber;

arranging the cross-over portion such that the heating element acts as an RF antenna moving portions of the microwave energy field to certain sections of the cooking chamber.

16. The method according to claim 15 further comprising: directing microwaves into the cooking chamber through toroidal waveguide.

17. The method according to claim 15 further comprising: arranging the inner and outer portion of the heating element whereby the cross-over portion is positioned across from a microwave launching zone.

* * * * *